US006628910B2

(12) United States Patent
Tanisawa et al.

(10) Patent No.: US 6,628,910 B2
(45) Date of Patent: Sep. 30, 2003

(54) TONER CARTRIDGE FOR IMAGE FORMING APPARATUS

(75) Inventors: Hiroshi Tanisawa, Nara (JP); Fumito Mizoguchi, Yamatokoriyama (JP); Hisashi Kunihiro, Nara (JP); Takeshi Wakabayashi, Kyoto (JP); Hiroshi Kawahito, Nara (JP); Hideaki Hagihara, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/119,807

(22) Filed: Apr. 11, 2002

(65) Prior Publication Data

US 2002/0150405 A1 Oct. 17, 2002

(30) Foreign Application Priority Data

Apr. 11, 2001 (JP) ..... 2001-113103

(51) Int. Cl.[7] ..... G03G 21/10; G03G 15/08
(52) U.S. Cl. ..... 399/120; 399/358
(58) Field of Search ..... 399/120, 359, 399/358, 360

(56) References Cited

U.S. PATENT DOCUMENTS 5,848,342 A * 12/1998 Tanda ..... 399/358
2002/0064395 A1 * 5/2002 Funayama et al. ..... 399/120

FOREIGN PATENT DOCUMENTS

| | | |
|---|---|---|
| JP | 04-237079 | 8/1992 |
| JP | 05-341697 | 12/1993 |
| JP | 08-044179 | 2/1996 |

* cited by examiner

*Primary Examiner*—Sophia S. Chen
(74) *Attorney, Agent, or Firm*—Birch, Stewart, Kolasch & Birch, LLP

(57) ABSTRACT

A toner container has a partitioning wall disposed therein for partitioning the toner container while allowing communication between partitioned compartments. A waste toner collecting port for receiving the waste toner collected by the cleaning unit of an image forming apparatus is formed in a waste toner collection department. A toner agitating element for mixing waste toner with unused toner is located inside the partitioned waste toner collection compartment.

8 Claims, 5 Drawing Sheets

TONER CARTRIDGE FOR IMAGE FORMING APPARATUS

BACKGROUND OF THE INVENTION (1) Field of the Invention

The present invention relates to a toner cartridge for use in an image forming apparatus such as a copier, printer, facsimile machine or the like.

(2) Description of the Prior Art

In a typical image forming apparatus, an image is reproduced and recorded on a sheet of printing paper by the electrophotographic process comprising the steps of: forming a latent electrostatic image on the photoconductor, supplying toner from the developing device to the photoconductor so as to develop the static latent image into a toner image and transferring the toner image onto the printing paper. The toner left on the photoconductor is removed as waste toner by the cleaning unit.

Since the waste toner thus removed is different in charge characteristics from unused toner and is degraded with paper particles resulting from printing sheets and other foreign substances, it is generally collected by a waste toner container which is provided separately from the unused toner container. Here, the amount of discharge of waste toner may differ depending on the usage environment of the machine, the quality of printing paper and the like. Further, the amount of waste toner may increase due to some unexpected events in the transfer step. Therefore, the waste toner container is so designed as to afford a sufficient margin as to its volume. As a result,the entire apparatus will become large. There is still a risk that the waste toner container might become full of waste toner and could not keep any more. In this case, the waste toner will leak out inside the machine and will contaminate the machine interior.

To deal with this, Japanese Patent Application Laid-Open Hei 4 No. 237079 discloses a configuration as shown in FIGS. 1 and 2, in which an unused toner container 102 and waste toner container 101 are provided so as to adjoin to each other with a partitioning wall 111 in-between, and the partitioning wall 111 is formed with an opening 103 having a shutter 110 which can be opened by the pressure of the toner in waste toner container 101 so as to allow the toner to move from the waste toner container 101 side to the unused toner container 102 side. In accordance with this configuration, when the waste toner container 101 becomes full of toner and hence is increased in pressure, the shutter will automatically open so that the waste toner can move into unused toner container 102. Therefore, it is possible to make the waste toner container 101 compact while preventing waste toner leakage. The waste toner having moved to unused toner container 102 through opening 103 is mixed with unused toner by a toner conveying and agitating element 109 in unused toner container 102. In the drawings, 104 designates a photoconductor, 105 a cleaning unit, 106 a waste toner conveying means, 107 a waste toner collecting pipe and 108 a developer roller.

Japanese Patent Application Laid-open Hei 8 No.44179 and Hei 5 No.341697 disclose waste toner container configurations for efficiently storing waste toner collected therein by uniformly distributing it. For example, as shown in FIG. 3, a toner conveying element 118 is provided in a waste toner container 116. With this arrangement, the waste toner having passed through a waste toner conveyance passage 119 is delivered into waste toner container 116 through waste toner collecting port 119*a,* and is efficiently collected in waste toner container 116 by means of toner conveying element 118. Resultantly, this configuration makes it possible to make waste toner container 116 compact. In the drawing, 115 designates an unused toner container, 115*a* an unused toner supplying port and 117 a partitioning wall.

For the former toner cartridge, waste toner moved to the unused toner container is mixed with unused toner by means of the toner conveying and agitating element inside the unused toner container, but there occur cases where waste toner is directly supplied to the toner supply means due to an insufficiency of the agitation. As a result, the toner image cannot be formed correctly at the developing step and image degradation will occur at the transfer step.

For the latter toner cartridge, the waste toner container is able to efficiently store the waste toner by its being evenly distributed, but since no waste toner will move from the waste toner container to the unused toner container, there is a limit to the downsizing of the waste toner container. Further, this configuration needs a weight detecting means or the like for detecting the state of the waste toner container being full. Resultantly, the apparatus configuration will become complicated and increased in cost.

SUMMARY OF THE INVENTION

The present invention has been devised in view of the above circumstances, it is therefore an object of the present invention to provide a toner cartridge for an image forming apparatus which eliminates the necessity of providing a separate waste toner container by collecting waste toner into an unused toner container without causing any image degradation, to thereby make the apparatus compact and reduce the cost.

In order to achieve the above object, the toner cartridge for an image forming apparatus of the present invention is configured as follows:

In accordance with the first aspect of the present invention, a toner cartridge for an image forming apparatus, includes: a toner container for holding toner; a toner supply element disposed inside the toner container for supplying the toner to a developing device of the image forming apparatus; and a toner conveying and agitating element for conveying the toner to the toner supply element whilst agitating the toner inside the toner container, and is characterized in that the toner container has a partitioning wall disposed therein for partitioning the toner container interior whilst allowing communication between the partitioned compartments, a waste toner collecting port for receiving the waste toner collected by a cleaning unit of the image forming apparatus is formed in one of the partitioned compartments, and a toner agitating element for mixing waste toner and unused toner is arranged inside the partitioned compartment having the waste toner collecting port.

In accordance with the second aspect of the present invention, the toner cartridge for an image forming apparatus having the above first feature is characterized in that a flexible element is attached to the toner agitating element.

In accordance with the third aspect of the present invention, the toner cartridge for an image forming apparatus having the above first feature is characterized in that the waste toner collecting port is formed at such a position that waste toner will enter the toner container in almost the same direction as that in which the toner agitating element rotates.

In accordance with the fourth aspect of the present invention, the toner cartridge for an image forming apparatus having the above first feature is characterized in that the partitioning wall is arranged at a position exterior to the end of the toner supply element.

In accordance with the fifth aspect of the present invention, the toner cartridge for an image forming apparatus having the above first feature is characterized in that the toner agitating element and toner conveying and agitating element in the different compartments partitioned by the partitioning wall are driven by a common rotary shaft.

In accordance with the sixth aspect of the present invention, the toner cartridge for an image forming apparatus having the above first feature is characterized in that the toner agitating element and toner conveying and agitating element in the different compartments partitioned by the partitioning wall are driven at different rotational rates.

In accordance with the seventh aspect of the present invention, the toner cartridge for an image forming apparatus having the above sixth feature is characterized in that the toner agitating element and toner conveying and agitating element in the different compartments partitioned by the partitioning wall are driven by a common drive source.

According to the present invention, the waste toner collected by the cleaning unit of the image forming apparatus is charged into the toner container through its waste toner collecting port so that the collected waste toner is mixed with unused toner by the toner agitating element. The thus mixed toner is transferred from the first compartment to second compartment partitioned by the partitioning wall. Then the toner is further mixed by the toner conveying and agitating element and supplied to the toner supply element.

According to the present invention, since the flexible element is adapted to rotate with its distal end following the inner surface of the toner container when waste toner and unused toner are mixed by the toner agitating element, a further enhanced mixing can be effected.

According to the present invention, the waste toner received through the waste toner collecting port is agitated without fail before it is transferred to the second compartment of the toner container.

According to the present invention, the toner mixed on the first compartment before passing through the partitioning wall can be transferred to the second compartment and agitated once again therein and supplied to the toner supply element by the toner conveying and agitating element.

According to the present invention, the toner agitating element and toner conveying and agitating element are driven by a common drive source.

According to the present invention, the amount of toner agitated by the toner agitating element and transferred from the first compartment to the second compartment is differentiated from the amount of toner supplied to the toner supply element by the toner conveying and agitating element.

According to the present invention, the toner agitating element and toner conveying and agitating element having different rotational rates are driven by a common drive source.

DESCRIPTION OF THE PREFERRED EMBODIMENTS

The embodiments of a toner cartridge of an image forming apparatus according to the present invention will be described with reference to the accompanying drawings.

Figure 1:
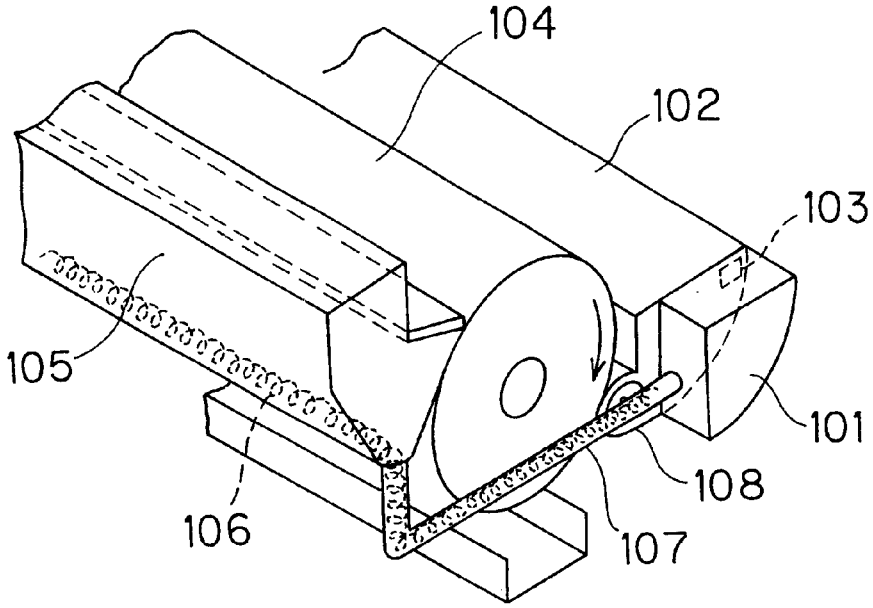
FIG. 1 PRIOR ART
FIG. 1 is a perspective view showing a toner cartridge of a conventional image forming apparatus.
Figure 2:
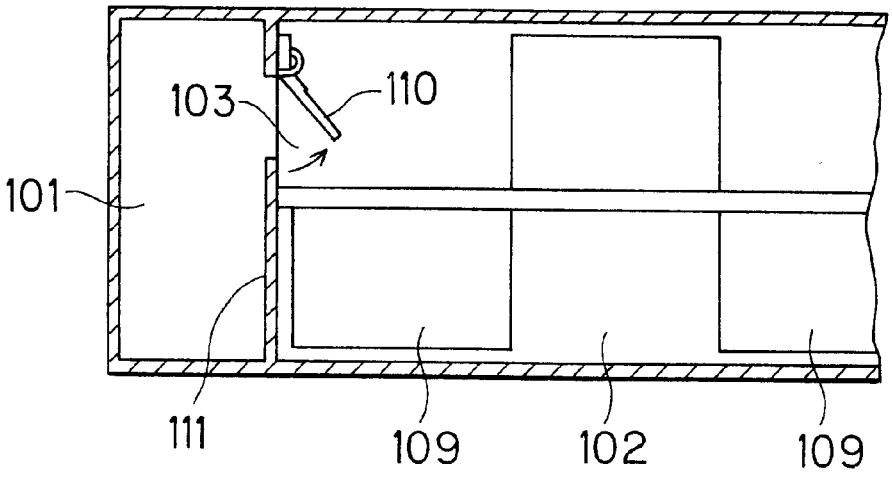
FIG. 2 PRIOR ART
FIG. 2 is a sectional view showing the toner cartridge of the conventional image forming apparatus shown in FIG. 1.
Figure 3:
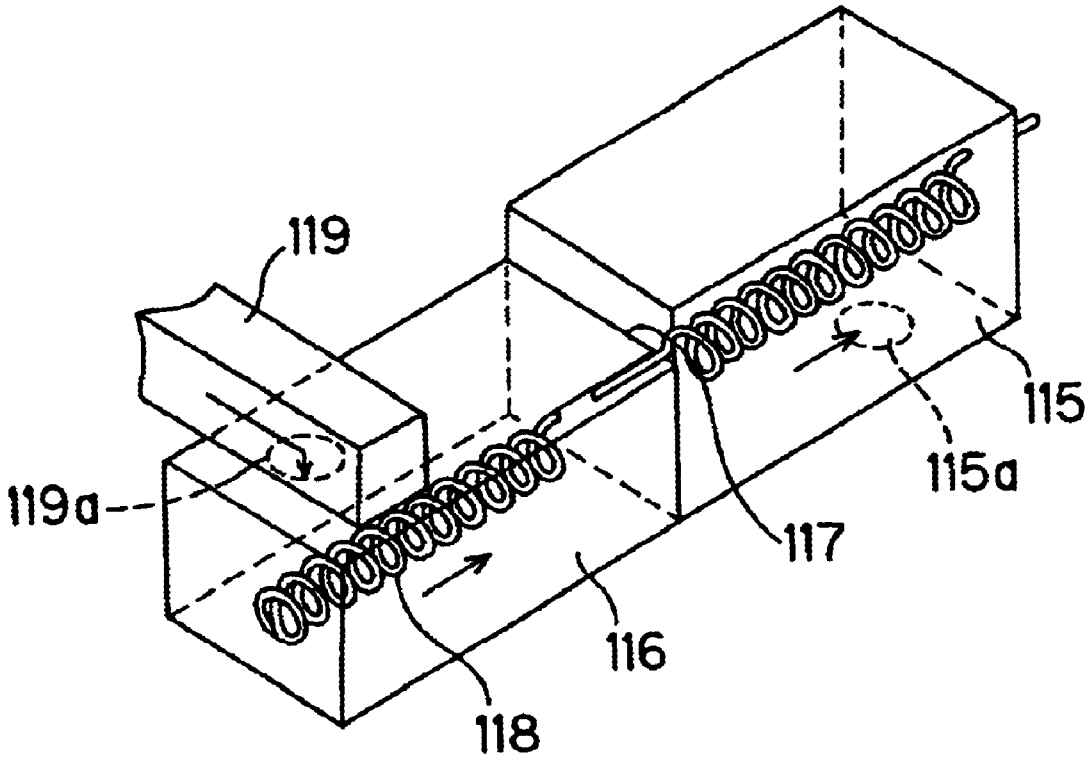
FIG. 3 PRIOR ART
FIG. 3 is a perspective view showing a toner cartridge of a conventional image forming apparatus.
Figure 4:
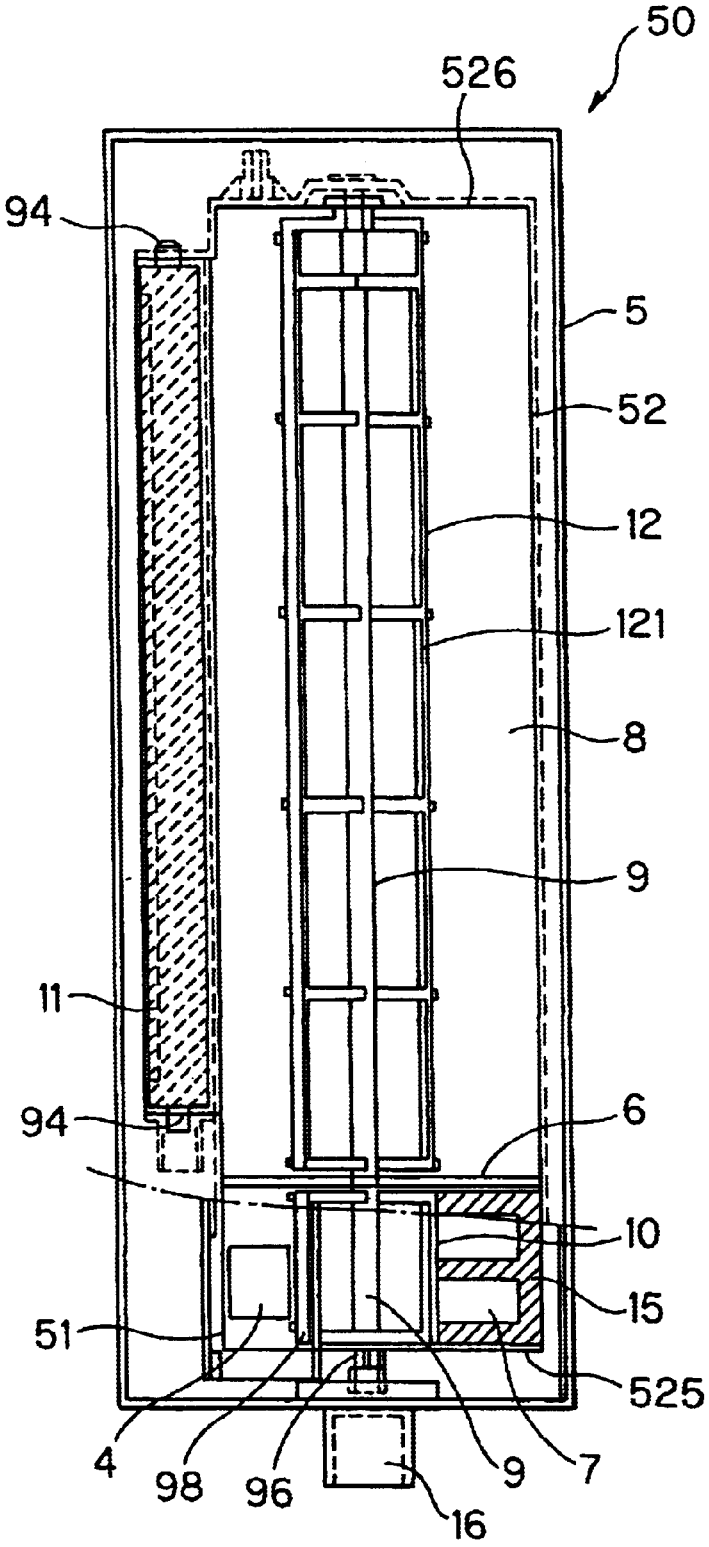
FIG. 4 is a front view showing a toner cartridge of an embodiment (1) of an image forming apparatus of the present invention.
Figure 5:
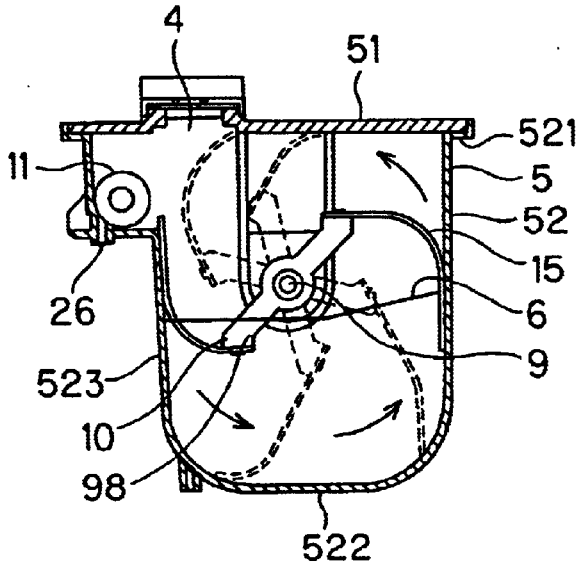
FIG. 5 is a sectional view showing the toner cartridge of the image forming apparatus shown in FIG. 4.
Figure 6:
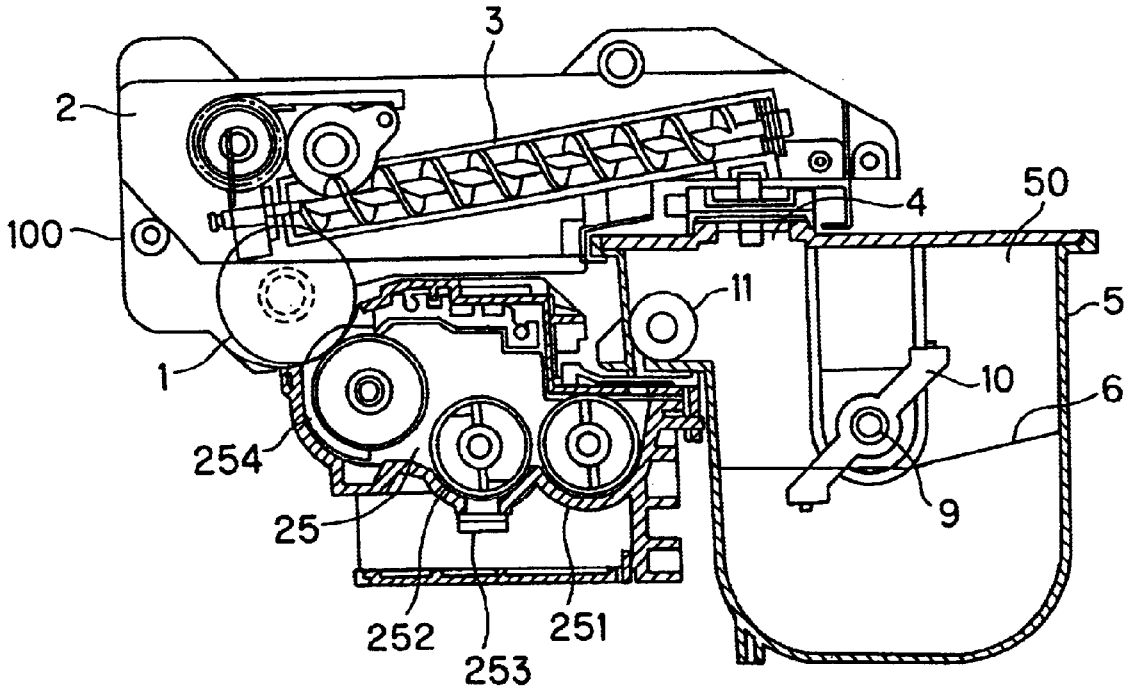
FIG. 6 is a side view showing a state where the toner cartridge of embodiment (1) of an image forming apparatus of the present invention is mounted to the developing unit of the image forming apparatus.

FIGS. 4 to 6 show a toner cartridge of an embodiment(1) of an image forming apparatus according to the present invention.

FIG. 6 shows a state where a toner cartridge 50 of the image forming apparatus of the present invention is mounted to the developing unit 100 of the image forming apparatus.

Developing unit 100 includes: a photoconductor 1 which forms a static latent image and is supplied with toner to form a toner image thereon by the electrophotographic process; a cleaning unit 2 for removing the leftover toner from the photoconductor 1; a waste toner conveyer pipe 3 for conveying the waste toner thus removed; a toner cartridge 50 holding unused toner and having a waste toner collecting port 4 for receiving the waste toner thus conveyed through the waste toner conveyer pipe; and a developing device 25 for delivering the toner from toner cartridge 50 to photoconductor 1. This developing device 25 has toner agitating elements 251 and 252, a toner concentration detecting sensor 253 and magnetic roller 254 which attracts the toner and supplies it to photoconductor 1.

Toner cartridge 50 is mainly comprised of a toner container 5, toner agitating element 10, toner supply element 11 and toner conveying and agitating element 12.

Toner container 5 is a cylindrical receptacle with a lid, and is composed of a top lid 51 and receptacle 52. The lid 51 and receptacle 52 are united by forming, for example, a stepped portion 521 in receptacle 52 and fitting the end face of top lid 51 to this stepped portion 521 so as to make watertight contact. Toner container 5 holds unused toner therein. The interior of toner container 5 is separated by a partitioning wall 6 into two spaces, namely, a waste toner collection compartment 7 and an unused toner storage compartment 8. Partitioning wall 6 is a plate having the cross-sectional shape of receptacle 52 and is formed at a position exterior to the end of toner supply element 11 and fixed upright from the bottom 522 of receptacle 52 leaving some opening space at the upper part so as to establish communication between waste toner collection compartment 7 and unused toner storage compartment 8. Further, in waste toner collecting compartment 7 of toner container 5, toner waste collecting port 4 for collecting the waste toner conveyed from cleaning unit 2 is formed on top lid 51 of toner container 5. Here, waste toner collecting port 4 is formed at such a position that waste toner will enter toner container 5 in almost the same direction as that in which toner agitating element 10 rotates. In the case of the drawing, since toner agitating element 10 rotates counterclockwise, toner collecting port 4 is arranged close to the left-side wall 523 of toner container 5.

Toner agitating element 10 is provided inside waste toner collection compartment 7 of toner container 5 and is comprised of a rotary shaft 9 and a rotary blade 98 fixed to the rotary shaft 9 to agitate toner. Rotary shaft 9 is axially and rotatably supported at its first end by end face 525 of receptacle 52 and at the second end by partitioning wall 6. The first end of rotary shaft 9 is extended out of receptacle 52 as an extension 96, on which a coupling 16 for transmitting the drive force to rotary shaft 9 is fixed. Connected to coupling 16 is an unillustrated motor or any other drive source. Here, extension 96 of rotary shaft 9 and coupling 16 may be joined by forming the cross-section of extension 96 of rotary shaft 9 into a D-shape, forming a D-shaped socket in the joining portion of coupling 16 and inserting the former into the latter by press fitting. Rotary blade 98 may have any shape as long as it can agitate the toner. For example, rotary blade 98 may have a plate-like configuration extending opposingly and outwardly to a definite distance from the rotary shaft 9 across the axis of rotary shaft 9. A flexible element 15 is attached to each end of rotary blade 98 so that its distal end can come in contact with the inner surface of toner container 5. As the examples of flexible element 15, resin sheets of polyethylene terephthalate, polycarbonate and the like can be used.

Toner supply element 11 is provided inside unused toner storage compartment 8 of toner container 5 and arranged close to a toner scraping portion 26 of toner container 5 functioning as the supply port, through which the toner is supplied to developing device 25. The toner supply element 11 has a cylindrical shape and is axially and rotatably supported at both ends 94 by receptacle 52 of toner container 5. The length of the toner supply element is designed to be marginally greater (by 3 to 5 mm) than the image forming width so that the toner can be reliably supplied to be electrostatic latent image formed on photoconductor 1.

Toner conveying and agitating element 12 is provided inside unused toner storage compartment 8 of toner container 5 and is comprised of rotary shaft 9 extended from toner agitating element 10 and a rotary blade 121 fixed to the rotary shaft 9 to agitate toner. The other end of rotary shaft 9 is axially and rotatably supported by the end face 526 of receptacle 52. Rotary blade 121 may have any shape as long as it can agitate the toner. For example, rotary blade 121 may have a plate-like configuration extending opposingly and outwardly from the rotary shaft 9 to a definite distance across the axis of rotary shaft 9.

Next, the operation of toner collection and supplying of the thus configured toner cartridge 50 will be described.

The waste toner collected by cleaning unit 2 is received through waste toner collecting port 4 of toner container 5 into waste toner collection compartment 7 which is partitioned by partitioning wall 6 in toner container 5. This waste toner collection compartment 7 of toner container 5 is adapted to hold unused toner from the start of use. Hence the waste toner collected through waste toner collecting port 4 is mixed with unused toner by toner agitating element 10 so that the waste toner is uniformly dispersed in the unused toner. As the next stage, the mixed toner, i.e., the mixture of waste toner and unused toner moves from the waste toner collection compartment 7 side to the unused toner storage compartment 8 side. This is done by leakage of the mixed toner from the waste toner collection compartment 7 side to the unused toner storage compartment 8 side via the communication portion above partitioning wall 6 as toner agitating element 10 makes agitating actions. Thereafter, the mixed toner is further agitated and mixed with the unused toner in unused toner storage compartment 8 of toner container 5 by toner conveying and agitating element 12, whereby the waste toner is further uniformly scatted in the unused toner. The thus sufficiently agitated, mixed toner is conveyed to toner supply element 11. When a toner concentration detecting sensor 253 of developing device 25 detects reduction in toner concentration, toner supply element 11 is driven by an unillustrated motor or other drive sources, whereby the toner is supplied through toner scraping portion 26 into developing device 25.

In this way, according to this embodiment (1), since the waste toner collected by cleaning unit 2 is charged into toner container 5 through waste toner collecting port 4 of toner container 5, it is not necessary to provide an extra waste toner container. As a result, it is possible to make the apparatus compact and reduce the cost. Since the toner cartridge integrally includes a waste toner container as a part thereof and hence can be constructed with fewer parts, the toner cartridge can be assembled in an easy manner and reduced in cost. Since waste toner is mixed on the waste toner collection compartment 7 side partitioned by partitioning wall 6 by toner agitating element 10 there after is moved to the unused toner storage compartment 8 side partitioned by partitioning wall 6 and further mixed by toner conveying and agitating element 12, the waste toner can be uniformly scattered in unused toner. As a result, it is possible to prevent image degradation due to waste toner.

Since flexible element 15 attached to toner agitating element 10 can rotate with its distal end following the inner surface of toner container 5, it is possible to afford a more enhanced design flexibility in determination of the shape of toner container 5. When flexible element 15 is formed with cutouts therein allowing the toner to pass therethrough while being agitated, it is possible to transfer the mixed toner into unused toner storage compartment 8, little by little, whilst leaving the mixed toner behind in the waste toner collection compartment 7. In this case, it is possible to control the amount of toner (the toner containing waste toner in a high ratio) left behind in the waste toner collection compartment, by adjusting the height of partitioning wall 6 and the configuration of flexible element 15 of toner agitating element 10.

Use of rotary shaft 9 common to toner agitating element 10 and toner conveying and agitating element 12 makes it possible to reduce the number of parts of the toner cartridge, hence assemble the toner cartridge in an easy manner with a reduced cost. Further, since the same drive source can be used to drive both elements, this contributes to making the apparatus compact and reducing its cost.

Figure 7:
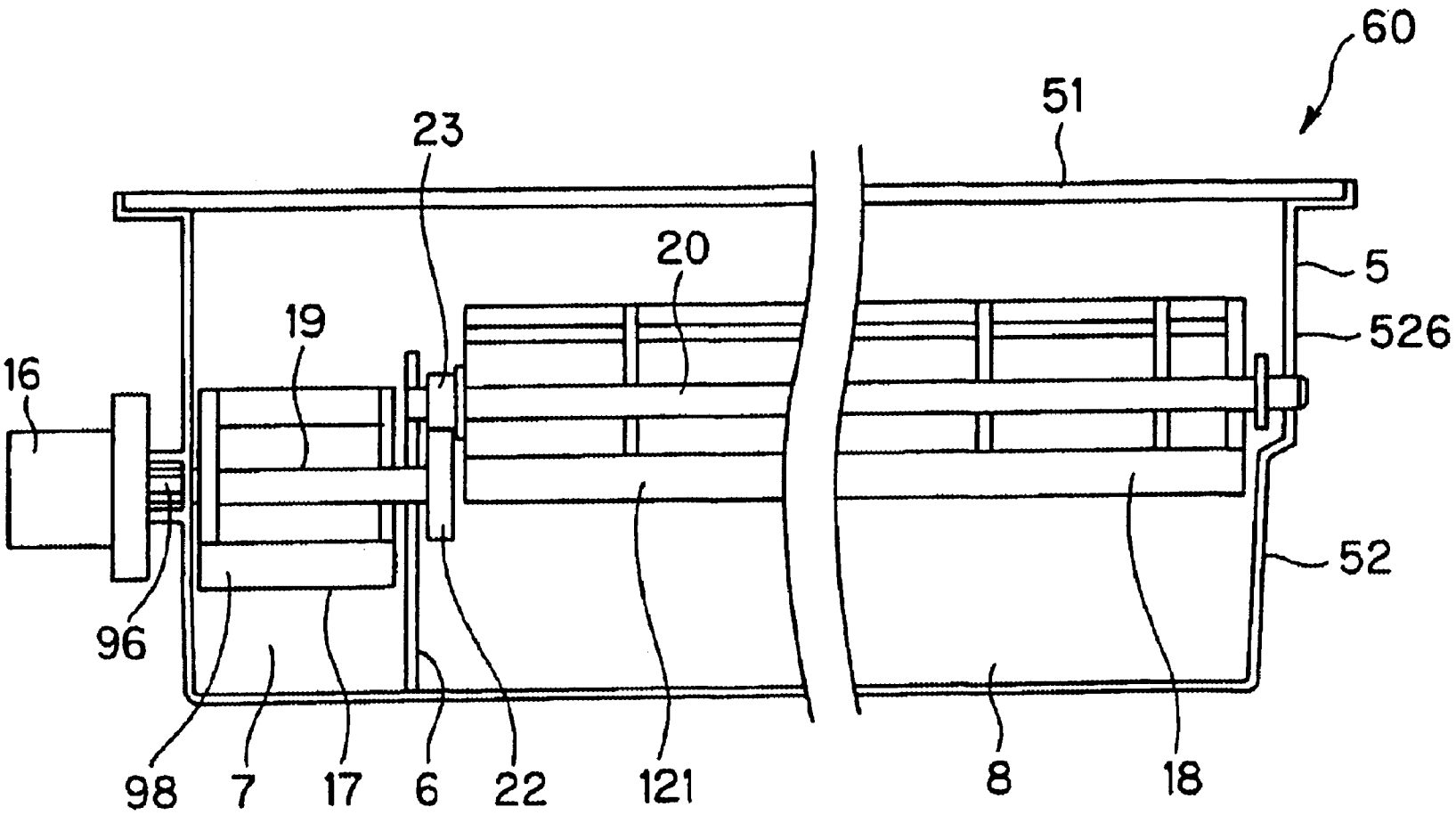
FIG. 7 is a front view showing a toner cartridge of an embodiment (2) of an image forming apparatus of the present invention.

Next, the embodiment (2) of the present invention will be described. FIG. 7 is a front view showing embodiment (2). Redundant description with respect to the embodiment (1) will be avoided by allotting the same reference numerals.

A toner cartridge 60 of an image forming apparatus of this embodiment (2) has individual rotary shafts 19 and 20 for toner agitating element 17 and toner conveying and agitating element 18, respectively. Rotary shaft 19 is axially and rotatably supported at its first end by end face 525 of receptacle 52 and at the second end by partitioning wall 6. The first end of rotary shaft 19 is extended out of receptacle 52 as an extension 102, on which a coupling 16 for transmitting the drive force to rotary shaft 19 is fixed. The other end of rotary shaft 19 is extended out of partitioning wall 6, forming an extension, on which a gear 22 is fitted. Rotary shaft 20 is axially and rotatably supported at its first end by partitioning wall 6 and at its second end by end face 526 of receptacle 52. A gear 23 meshing gear 22 is fitted on the first end of rotary shaft 20. Gears 22 and 23 used here are set so that, for example, gear 22 has 15 gear teeth and gear 23 has 10 gear teeth. In this case, toner agitating element 17 and toner conveying and agitating element 18 are driven by the same drive source at a rotational ratio of 2:3. It is also possible to drive toner agitating element 17 at a rotational rate higher than that of toner conveying and agitating element 18, by adjusting the gear ratio between gears 22 and 23 in contrast to the above configuration.

According to the embodiment (2), since it is possible to make the rotational rate of toner agitating element 17 and that of toner conveying and agitating element 18 different, it is possible to control the amount of the mixture of waste toner and unused toner to be fed over partitioning wall 6 by toner agitating element 17 from the waste toner collection compartment 7 side to the unused toner storage compartment 8 side and the amount of the mixed toner to be fed by toner conveying and agitating element 18 to toner supply element 11. For example, by setting the rotational rate of toner agitating element 17 lower than that of toner conveying and agitating element 18, the mixture of waste toner and unused toner can be sent, little by little, from the waste toner collection compartment 7 side to the unused toner storage compartment 8 side in the toner container. With this setting, the toner containing a high ratio of unused toner in the unused toner storage compartment 8 will run out first while the toner containing a high ratio of waste toner remains in waste toner collection compartment 7. Accordingly, it is possible to stop the image forming apparatus when this condition occurs by displaying the toner empty indication.

As has been described heretofore, according to the present invention, the toner container has a partitioning wall therein for partitioning the toner container whilst allowing communication between the compartments, a waste toner collecting port for receiving the waste toner collected by the cleaning unit is formed in one of the partitioned compartments and a toner agitating element for mixing waste toner with unused toner is arranged inside the partitioned compartment of the waste toner collecting port. As a result, it is not necessary to provide an extra waste toner container, hence the apparatus can be made compact and reduced in cost. Further, because the waste toner can be sufficiently mixed with the unused toner, it is possible to prevent image degradation due to waste toner.

According to the present invention, in the toner cartridge for an image forming apparatus a flexible element is attached to the toner agitating element. Therefore, the flexible element rotates with its distal end following the inner surface of the toner container so as to perform further enhanced mixing, whereby it is possible to prevent image degradation due to waste toner. Further this configuration makes it possible to afford a more enhanced design flexibility in determination of the shape of the toner container.

According to the present invention, in the toner cartridge for an image forming apparatus, the waste toner collecting port is formed at such a position that waste toner will enter the toner container in almost the same direction as that in which the toner agitating element rotates. Accordingly, the waste toner received through the waste toner collecting port can be agitated without fail by the toner agitating element and then conveyed to the other side of the toner container. In this way, this configuration is effective in reliably preventing image degradation due to waste toner.

According to the present invention, in the toner cartridge for an image forming apparatus, the partitioning wall is arranged at a position exterior to the end of the toner supply element. Therefore, the toner mixed on the first compartment before passing through the partitioning wall can be transferred to the second compartment and agitated once again therein and supplied to the toner supply element by the toner conveying and agitating element. As a result it is possible to reliably prevent image degradation due to waste toner.

According to the present invention, in the toner cartridge for an image forming apparatus, use of a rotary shaft common to the toner agitating element and the toner conveying and agitating element makes it possible to reduce the number of parts of the toner cartridge, hence assemble the toner cartridge in an easy manner with a reduced cost. Further, since the same drive source can be used to drive both elements, this contributes to making the apparatus compact and reducing its cost.

According to the present invention, in the toner cartridge for an image forming apparatus the toner agitating element and toner conveying and agitating element can be driven at different rotational rates, hence it is possible to control the amount of the mixture of waste toner and unused toner to be fed from the first compartment to the second compartment over the partitioning wall by the toner agitating element and the amount of the mixed toner to be fed to the toner supply element by the toner conveying and agitating element.

According to the present invention, in the toner cartridge for an image forming apparatus the toner agitating element and toner conveying and agitating element in the different compartments partitioned by the partitioning wall are driven by a common drive source. Thus, since the toner agitating element and the toner conveying and agitating element having different rotational rates from one another can be driven by the same drive source, this configuration is effective in making the apparatus compact and reducing the cost.

What is claimed is:

1. A toner cartridge for an image-forming apparatus, comprising:

a toner container for holding toner;

a toner supply element disposed inside the toner container for supplying the toner to a developing device of the image forming apparatus; and a toner conveying and agitating element for conveying the toner to the toner supply element while agitating the toner inside the toner container, the toner container has a partitioning wall disposed therein for partitioning the toner container interior into partitioned compartments while allowing communication between the partitioned compartments, a waste toner collecting port for receiving the waste toner collected by a cleaning unit of the image forming apparatus is formed in one of the partitioned compartments, and a toner agitating element for mixing waste toner and unused toner is located inside the partitioned compartment having the waste toner collecting port.

2. The toner cartridge for an image forming apparatus according to claim 1, wherein a flexible element is attached to the toner agitating element.

3. The toner cartridge for an image forming apparatus according to claim 1, wherein the waste toner collecting port is formed at such a position, so that waste toner will enter the toner container in almost the same direction as that in which the toner agitating element rotates.

4. The toner cartridge for an image forming apparatus according to claim 1, wherein the toner supply element has two ends, and the partitioning wall is arranged at a position exterior to one end of the toner supply element.

5. The toner cartridge for an image forming apparatus according to claim 1, wherein the toner agitating element and toner conveying and agitating element in the different compartments partitioned by the partitioning wall are driven by a common rotary shaft.

6. The toner cartridge for an image forming apparatus according to claim 1, wherein the toner agitating element and toner conveying and agitating element in the different compartments partitioned by the partitioning wall are driven at different rotational rates.

7. The toner cartridge for an image forming apparatus according to claim 6, wherein the toner agitating element and toner conveying and agitating element in the different compartments partitioned by the partitioning wall are driven by a common drive source.

8. The toner cartridge for an image forming apparatus according to claim 1, wherein the toner agitating element and toner conveying and agitating elements in the different compartments are attached to separate shafts.

* * * * *